US005571781A

United States Patent [19]

Boutique

[11] Patent Number: 5,571,781

[45] Date of Patent: Nov. 5, 1996

[54] NON-AQUEOUS LIQUID DETERGENT COMPOSITIONS

[75] Inventor: Jean-Pol Boutique, Genbloux, Belgium

[73] Assignee: The Procter & Gamble Company, Cincinnati, Ohio

[21] Appl. No.: 416,687

[22] PCT Filed: Oct. 13, 1993

[86] PCT No.: PCT/US93/09799

§ 371 Date: Apr. 7, 1995

§ 102(e) Date: Apr. 7, 1995

[87] PCT Pub. No.: WO94/09101

PCT Pub. Date: Apr. 28, 1994

[30] Foreign Application Priority Data

Oct. 13, 1992 [GB] United Kingdom ..... 92871064
Nov. 6, 1992 [GB] United Kingdom ..... 92870182

[51] Int. Cl.[6] ..... C11D 3/32; C11D 3/42; C11D 3/04

[52] U.S. Cl. ..... 510/339; 510/350; 510/345; 510/502; 510/325; 510/338

[58] Field of Search ..... 252/548, 174.17, 252/164, 174.21, 139, 529, 174.23

[56] References Cited

U.S. PATENT DOCUMENTS

| | | | |
|---|---|---|---|
| 3,654,166 | 4/1972 | Eckert et al. | 252/117 |
| 4,326,979 | 4/1982 | Bus et al. | 252/158 |
| 4,889,652 | 12/1989 | Sullivan et al. | 252/99 |
| 5,011,622 | 4/1991 | Schepers | 252/174.15 |
| 5,174,927 | 12/1992 | Honsd | 252/543 |
| 5,223,179 | 6/1993 | Connor et al. | 252/548 |
| 5,236,612 | 8/1993 | Rahman et al. | 252/89.1 |
| 5,244,593 | 9/1993 | Roselle et al. | 252/99 |
| 5,269,974 | 12/1993 | Ofosu-Asante | 252/544 |

*Primary Examiner*—Erin M. Harriman
*Attorney, Agent, or Firm*—George W. Allen; T. David Reed

[57] ABSTRACT

The present invention is a non-aqueous detergent composition comprising a surfactant comprising 2 vicinal hydroxyl groups selected from poly hydroxy fatty acid amides, alkyl mono and di(alkoxy) glyceryl ethers, alkane 1,2-diols, alkyl glycerates and N-alkyl-lactobioamides, and a boron comprising compound. The molar ratio of said surfactant to said boron comprising compound are equal to or lower than 2:1.

5 Claims, No Drawings

NON-AQUEOUS LIQUID DETERGENT COMPOSITIONS

FIELD OF THE INVENTION

The present invention is related to non-aqueous liquid detergent compositions.

BACKGROUND OF THE INVENTION

Detergent compositions have traditionally contained a number of non-active ingredients. This has resulted in the increase in volume of the compositions and thus the packaging therefore. It is now considered highly desirable to reduce the volume of detergent compositions due to environmental considerations and produce more compact detergent formulations. One means to achieve this is to reduce the amount of non active ingredients such as water in detergent compositions. Reducing and preferably removing non active ingredients, particularly water results in a more compact composition. This in turn results in the need for less packaging material and smaller more manageable containers.

Thus, it is an object of the present invention to formulate non-aqueous detergent compositions which exhibit at least the same cleaning performance of an equivalent aqueous detergent composition.

In order to achieve the required cleaning performance, it is desirable to incorporate surfactants comprising 2 vicinal hydroxyl groups selected from poly hydroxy fatty acid amides, alkyl mono or di(alkoxy) glyceryl ethers, alkane 1,2-diols, alkyl glycerates and N-alkyl-lactobionamides. This is because such surfactants are especially effective with respect to their greasy stain removal performance.

Unfortunately, it has been found that said surfactants comprising 2 vicinal hydroxyl groups are not soluble in non-aqueous compositions and form precipitates.

Thus, it is a further object of the present invention to incorporate these surfactants comprising 2 vicinal hydroxyl groups in non-aqueous compositions without the precipitation of the surfactant in the composition.

In response to this object it has now been found that these surfactants comprising 2 vicinal hydroxyl groups can indeed be solubilized in non-aqueous detergent compositions. This is achieved by the addition of a boron comprising compound such as boric acid.

Without wanting to be bound by theory it is believed that the boron comprising compound interacts with the hydroxyl groups of the surfactant to form complexes. These complexes disrupt the crystallinity of the surfactant and thereby prevent its precipitation.

Another advantage of the present invention is that certain ingredients such as dye transfer inhibition systems which are not compatible with an aqueous environment can be incorporated into non-aqueous liquid detergent compositions. This contributes to overall cleaning performance of liquid detergent compositions.

SUMMARY OF THE INVENTION

The present invention is a non-aqueous liquid detergent composition comprising a surfactant comprising 2 vicinal hydroxyl groups selected from poly hydroxy fatty acid amides, alkyl mono- or di(alkoxy)glyceryl ethers, alkane 1,2-diols, alkyl glycerates and N-alkyl-lactobionamides characterized in that said composition further comprises a boron comprising compound wherein the molar ratio of said surfactant to said boron comprising compound is equal or lower than 2:1.

All amounts, parts and percentages are given as a % weight of the total composition unless otherwise stated.

DETAILED DESCRIPTION OF THE INVENTION

The present invention is a non-aqueous liquid detergent composition comprising a surfactant comprising 2 vicinal hydroxyl groups. Said surfactant is solubilized in the non-aqueous composition by the incorporation of a boron comprising compound.

As used herein the term non aqueous compositions refers to compositions which are substantially non-aqueous and comprise less than 5% water, preferably from 0.1% to 3% water.

The term detergent composition as used herein refers to complete formulations, premixes and liquid anhydrous bases in which other solid ingredients such as builders and bleaches may be suspended.

Surfactants Comprising 2 Vicinal Hydroxyl Groups

According to the present invention the compositions comprise a surfactant comprising 2 vicinal hydroxyl groups and mixtures thereof. Suitable surfactants comprising 2 vicinal hydroxyl groups include; surfactants derived from poly hydroxy fatty acid amides, alkyl mono or di(alkoxy) glyceryl ethers, alkane 1,2 diols, alkyl glycerates and N-alkyl lactobionamides.

The compositions of the present invention comprise from 2% to 80%, preferably from 5% to 50%, most preferably from— 5% to 15% of said surfactant comprising 2 vicinal hydroxyl groups.

According to the present invention highly preferred surfactants comprising 2 vicinal hydroxyl groups are polyhydroxy fatty acid amide surfactants and mixtures thereof. Suitable poly hydroxy fatty acid amides for use herein are according to the formula:

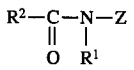

wherein $R^1$ is H, $C_1$–$C_4$ hydrocarbyl, 2-hydroxy ethyl, 2-hydroxy propyl or a mixture thereof, preferably $C_1$–$C_4$ alkyl, more preferably $C_1$ or $C_2$ alkyl most preferably $C_2$ alkyl, $R_2$ is $C_{5-31}$ hydrocarbyl, preferably straight chain $C_7$–$C_{19}$ alkyl or alkenyl, more preferably straight chain $C_{11-17}$ alkyl or alkenyl or mixture thereof and Z is a polyhydroxyhydrocarbyl having a linear hydrocarbyl chain with at least 2 hydroxyls directly connected to the chain, or an alkoxylated derivative (preferably ethoxylated or propoxylated) thereof. Z preferably is derived from a reducing sugar in a reductive amination reaction; more preferably Z is a glycityl. Suitable reducing sugars include glucose, fructose, maltose, lactose, galactose mannose and xylose. Z is preferably selected form the group cons $—CH_2—(CHOH)_n—CH_2OH$, $CH(CH_2OH)—(CHOH)_{n-1}—CH_2OH$, $—CH_2—(CHOH)_2(CHOR')(CHOH)—CH_2OH$, where n is an integer from 3 to 5, inclusive, and R' is H or a cyclic or aliphatic monosaccharide and alkoxylated derivatives thereof. Most preferred are glycityls wherein n is 4, particularly $—CH_2—(CHOH)_4—CH_2OH$. Z can be 1-deoxylactityl, 1-deoxyglucityl, 2-deoxyfructityl, 1-deoxymaltityl, 1-deoxylactityl, 1deoxygalactityl, 1-deoxymannityl, 1-deomaltotriotityl.

$R_1$ can be for example N-methyl, N-ethyl, N-propyl, N-isopropyl, N-butyl, N-2-hydroxy ethyl, or N-2-hydroxy propyl. $R_2$ is a straight $C_{11-15}$ alkyl or alkenyl chain or mixtures thereof. The compositions according to the present invention comprise from 2% to 80%, preferably from 5% to 50%, most preferably from 5% to 15% of poly hydroxy fatty acid amide surfactants.

Other suitable surfactants comprising 2 vicinal hydroxy groups are selected from the group consisting of alkyl mono or di(alkoxy)glyceryl ethers, alkane 1,2-diols, alkyl glycerates and N-alkyl lactobionamides.

Suitable alkyl mono or di (alkoxy) glyceryl ethers are $C_{8-18}$ alkyl mono (alkoxy) glyceryl ethers according to the formula:

$$R—O—[CH_2CH_2O]_n—CH_2—CHOH—CH_2OH$$

wherein R is a $C_{8-18}$ alkyl or alkenyl group and n is from 0 to 6.

Suitable alkyl di(alkoxy) glyceryl ethers are $C_{8-18}$ alkyl di(alkoxy) glyceryl ethers according to the formula:

$$R—O—[CH_2CH_2O]_n—CH_2—CHOH—CH_2—O—CH_2—CHOH—CH_2OH \text{ or}$$

$$R—O—[CH_2CH_2O]_n—CH_2—CHOH—CH_2—O—CH—CH_2OH \quad CH_2OH$$

where R is a $C_{8-18}$ alkyl or alkenyl group and n is from 0 to 6.

Suitable alkane diols are $C_{8-18}$ alkyl 1,2 diols, preferably $C_{10-12}$ alkyl 1,2 diols. Suitable alkylglycerates are $C_{8-18}$ alkylglycerates according to the formula:

$$R—OOC—CHOH—CH_2OH$$

where R is preferably $C_{10-12}$.

Suitable N-alkyl lactobionamides are N—$C_{8-18}$ alkyl lactobionamides according to the formula:

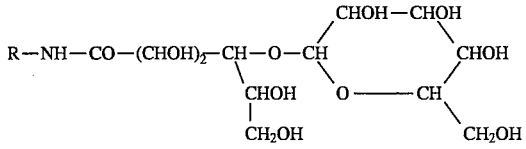

wherein R is a $C_{8-18}$ alkyl or alkenyl group.

The surfactant comprising 2 vicinal hydroxyl groups of the present invention is solubilized in the non-aqueous composition by the incorporation of a boron comprising compound.

Boron Comprising Compound

The boron comprising compound employed herein can be boric acid or one of its salts, or mixtures thereof. Preferred salts are the alkanolamine salts of tetraborate or metaborate. Most preferred are boric acid and monoethanolamine borate. According to the present invention the compositions comprise from 0.1% to 10%, preferably from 0.5% to 5%, most preferably from 2% to 4% of the boron comprising compound.

According to the present invention the molar ratio of said surfactant comprising 2 vicinal hydroxyl groups to said boron comprising compound material is equal or lower than 2:1, preferably equal or lower than 1.5:1, most preferably equal or lower than 1:1.

The rest of the liquid detergent composition according to the present invention is made of conventional detergency ingredients, i.e. other surfactants, builders, bleaches, enzymes, polymers, brighteners and others.

The liquid detergent compositions herein may additionally comprise as an optional ingredient from 2% to 90%, preferably from 5% to 50% of an organic surface-active agent selected from anionic, nonionic, cationic and zwitterionic surface active agents and mixtures thereof.

According to the present invention the compositions may further comprise a dye transfer inhibition system. Suitable dye transfer inhibiting systems for use herein include DTI systems comprising a non-iron metallo catalyst. Suitable non-iron metallo catalysts may be selected from:

a) non-iron metallo porphin and water-soluble or water-dispersible derivatives thereof;

b) non-iron metallo porphyrin and water-soluble or water-dispersible derivatives thereof;

c) non-iron metallo phthalocyanine and water-soluble or water-dispersible derivatives thereof;

The preferred usage range of the catalyst in the wash is $10^{-8}$ molar to $10^{-3}$ molar, more preferred $10^{-6}$ –$10^{-4}$ molar.

The metallo porphin structure may be visualized as indicated in Formula I set forth hereinafter. In Formula I the atom positions of the porphin structure are numbered conventionally and the double bonds are put in conventionally. In other Formulas II and III hereinafter, the double bonds have been omitted in the structures, but are actually present as in I.

Preferred metallo porphin structures are those substituted at one or more of the 5, 10, 15 and 20 carbon positions of Formula I (Meso positions), with a phenyl or pyridyl substituent selected from the group consisting of

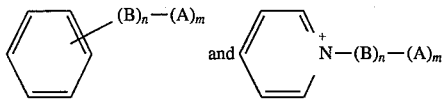

wherein n and m may be 0 or 1; A is selected from water-solubilizing group, e.g., sulfate, sulfonate, phosphate, and carboxylate groups; and B is selected from the group consisting of $C_1$–$C_{10}$ alkyl, $C_1$–$C_{10}$ polyethoxy alkyl or $C_1$–$C_{10}$ hydroxy alkyl.

Preferred molecules are those in which the substituents on the phenyl or pyridyl groups are selected from the group consisting of —$CH_3$, —$C_2H_5$, —$CH_2CH_2CH_2SO_3$—, —$CH_2$——, and —$CH_2CH(OH)CH_2SO_3$—, —$SO_3$ A particularly preferred metallo phorphin is one in which the molecule is substituted at the 5, 10 15, and 20 carbon positions with the substituent

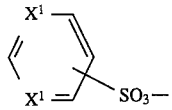

This preferred compound is known as metallo tetrasulfonated tetraphenylporphin. The symbol $X^1$ is (=CY—) wherein each Y, independently, is hydrogen, chlorine, bromine, fluorine or meso substituted alkyl, cycloalkyl, aralkyl, aryl, alkaryl or heteroaryl.

The symbol $X^2$ of Formula I represents an anion, preferably $OH^-$ or $Cl^-$. The compound of Formula I may be substituted at one or more of the remaining carbon positions with $C_1$–$C_{10}$ alkyl, hydroxyalkyl or oxyalkyl groups.

(I)

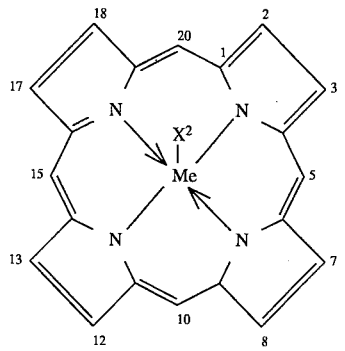

Porphin derivatives also include chlorophyls, chlorines, i.e. isobacterio chlorines and bacteriochlorines.

Metallo porphyrin and water-soluble or water-dispersible derivatives thereof have a structure given in formula II.

(II)

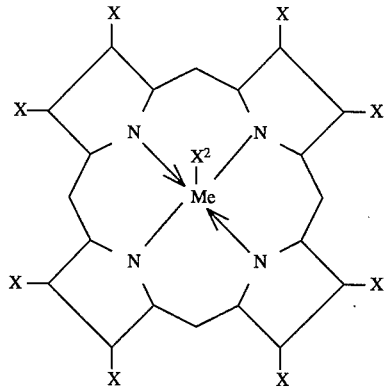

where X can be alkyl, alkyl carboxy, alkyl hydroxyl, vinyl, alkenyl, alkyl sulfate, alkylsulfonate, sulfate, sulfonate, aryl.

The symbol $X^2$ of Formula II represents an anion, preferably $OH^-$ or $Cl^-$.

The symbol $X_i$ can be alkyl, alkylcarboxy, alkylhydroxyl, vinyl, alkenyl, alkylsulfate, alkylsulfonate, sulfate, sulfonate.

Metallo phthalocyanine and derivatives have the structure indicated in Formula III, wherein the atom positions of the phthalocyanine structure are numbered conventionally. The anionic groups in the above structures contain cations selected from the group consisting of sodium and potassium cations or other non-interfering cations which leave the structures water-soluble. Preferred phthalocyanine derivatives are metallo phthalocyanine trisulfonate and metallo phthalocyanine tetrasulfonate.

(III)

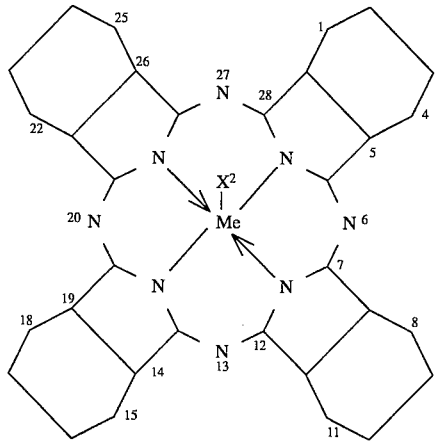

Still a number of considerations are significant in selecting variants of or substituents in the basic porphin or azaporphin structure. In the first place, one would choose compounds which are available or can be readily synthesized.

Beyond this, the choice of the substituent groups can be used to control the solubility of the catalyst In water or in detergent solutions. Yet again, especially where it is desired to avoid attacking dyes attached to solid surfaces, the substituents can control the affinity of the catalyst compound for the surface. Thus, strongly negatively charged substituted compounds, for instance the tetrasulfonated porphin, may be repelled by negatively charged stained surfaces and are therefore most likely not to cause attack on fixed dyes, whereas the cationic or zwitterionic compounds may be attracted to, or at least not repelled by such stained surfaces.

Another dye transfer inhibition system for use herein comprises polyamine N-oxide containing polymers.

Polyamine N-oxide polymers are those which contain units having the following structure formula:

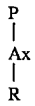

wherein P is a polymerisable unit, whereto the R—N—O group can be attached to or wherein the R—N—O group forms part of the polymerisable unit or a combination of both.

A is

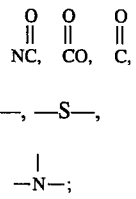

x is or O or 1;

R are aliphatic, ethoxylated aliphatics, aromatic, heterocyclic or alicyclic groups or any combination thereof whereto the nitrogen of the N—O group can be attached or wherein the nitrogen of the N—O group is part of these groups.

The N—O group can be represented by the following general structures:

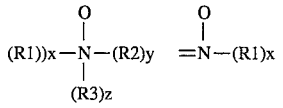

wherein R1, R2, R3 are aliphatic groups, aromatic, heterocyclic or alicyclic groups or combinations thereof, x or/and y or/and z is 0 or 1 and wherein the nitrogen of the N—O group can be attached or wherein the nitrogen of the N—O group forms part of these groups.

The N—O group can be part of the polymerisabie unit (P) or can be attached to the polymeric backbone or a combination of both. Suitable polyamine N-oxides wherein the N—O group forms part of the polymerisable unit comprise polyamine N-oxides wherein R is selected from aliphatic, aromatic, alicyclic or heterocyclic groups.

One class of said polyamine N-oxides comprises the group of polyamine N-oxides wherein the nitrogen of the N—O group forms part of the R-group. Preferred polyamine N-oxides are those wherein R is a heterocyclic group such as pyridine, pyrrole, imidazole, pyrrolidine, piperidine and derivatives thereof. Another class of said polyamine N-oxides comprises the group of polyamine N-oxides wherein the nitrogen of the N—O group is attached to the R-group.

Other suitable polyamine N-oxides are the polyamine oxides whereto the N—O group is attached to the polymerisable unit. Preferred class of these polyamine N-oxides are the polyamine N-oxides having the general structure hereinbefore wherein R is an aromatic, heterocyclic or alicyclic groups wherein the nitrogen of the N—O functional group is part of said R group.

Examples of these classes are polyamine oxides wherein R is a heterocyclic compound such as pyridine, pyrrole, imidazole and derivatives thereof.

Another preferred class of polyamine N-oxides are the polyamine oxides having the general structure hereinbefore wherein R are aromatic, heterocyclic or alicyclic groups wherein the nitrogen of the N—O functional group is attached to said R groups. Examples of these classes are polyamine oxides wherein R groups can be aromatic such as phenyl.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof.

The amine N-oxide polymers of the present invention typically have a ratio of amine to the amine N-oxide of 10:1 to 1:1000000. However the amount of amine oxide groups present in the polyamine oxide polymer can be varied by appropriate copolymerization or by appropriate degree of N-oxidation. Preferably, the ratio of amine to amine N-oxide is from 3:1 to 1:1000000. The polymers of the present invention actually encompass random or block copolymers where one monomer type is an amine N-oxide and the other monomer type is an N-oxide or not.

The amine oxide unit of the polyamine N-oxides has a pKa<10, preferably pKa<7, more preferred pKa<6. The polyamine oxides can be obtained in almost any degree of polymerisation. The degree of polymerisation is not critical provided the material has the desired water-solubility and dye-suspending power. Typically, the average molecular weight is within the range of 500 to 1000,000; more preferred 1000 to 500,000; most preferred 5000 to 100,000.

The polyamine N-oxides of the present invention are typically present from 0.01 to 10%, more preferably from 0.05 to 1%, most preferred from 0.05 to 0.5% by weight of the dye transfer inhibiting composition.

Dye transfer inhibition systems comprising said polyamine N-oxide containing polymers may additionally be used in combination with the metallo catalysts hereinbefore described.

According to the present invention the composition may comprise a number of additional compounds commonly used in liquid detergent compositions such solvents, chelants, enzymes, perfumes, dyes which are well known and described in the art.

The present invention may be illustrated by the following examples wherein all the ingredients listed below are combined.

| | EXAMPLES | | | | | | | | | |
|---|---|---|---|---|---|---|---|---|---|---|
| Example | I | II | III | IV | V | VI | VII | VIII | IX | X |
| Polyethyleneglycol 200 | 35 | 35 | 35 | 35 | 35 | 35 | 35 | 35 | 30 | 0 |
| C12–14 EO 3 | 15 | 15 | 15 | 15 | 15 | 15 | 15 | 15 | 15 | 15 |
| C12–14 EO 7 | 15 | 15 | 15 | 15 | 15 | 15 | 15 | 15 | 15 | 15 |
| Propanedial | 0.6 | 0.6 | 0.6 | 0.6 | 1.1 | 1.1 | 0 | 0 | 0 | 35 |
| C12 N - methyl glucamide | 5 | 5 | 5 | 10 | 10 | 10 | 0 | 0 | 6 | 10 |
| C12 N - butyl glucamide | 0 | 0 | 0 | 0 | 0 | 0 | 10 | 10 | 0 | 0 |
| C12 N - methoxypropyl glucamide | 0 | 0 | 0 | 0 | 0 | 0 | 0 | 0 | 0 | 0 |
| C12 N - methyl glycerolamide | 0 | 0 | 0 | 0 | 0 | 0 | 0 | 0 | 0 | 0 |
| C12 N - methyl xylose amide | 0 | 0 | 0 | 0 | 0 | 0 | 0 | 0 | 0 | 0 |
| Na C 12–14 Alkyl Sulphate | 0 | 0 | 0 | 0 | 0 | 0 | 0 | 0 | 5.1 | 0 |
| Boric acid | 0 | 0.82 | 1.67 | 0 | 1.67 | 3.28 | 0 | 1 | 1.7 | 0 |
| Poly Vinyl Pyrrolidone N - oxide | 0 | 0 | 0 | 0 | 0 | 0 | 0 | 0 | 0 | 0 |
| Total parts | 70.6 | 71.4 | 72.3 | 75.6 | 77.8 | 79.4 | 75.0 | 76.0 | 72.8 | 75.0 |
| Polyol surfactant/ boric acid molar ratio | oo | 1 | 0.49 | oo | 1 | 0.5 | oo | 1.48 | 0.58 | oo |

Examples I, IV, VII, X, outside the scope of the invention, show poor physical stability. The other examples where the molar ratio of the polyol surfactant/boric acid is equal or lower than 2 show good physical stability.

| Example | EXAMPLES XI | XII | XIII | XIV | XV | XVI | XVII | XVIII |
|---|---|---|---|---|---|---|---|---|
| Polyethyleneglycol 200 | 0 | 35 | 35 | 50 | 50 | 50 | 50 | 0 |
| C12–14 EO 3 | 15 | 15 | 15 | 21.4 | 21.4 | 21.4 | 21.4 | 15 |
| C12–14 EO 7 | 15 | 15 | 15 | 21.4 | 21.4 | 21.4 | 21.4 | 15 |
| Propanediol | 35 | 0 | 0 | 0 | 0 | 0 | 0 | 35 |
| C12 N - methyl glucamide | 10 | 0 | 0 | 0 | 0 | 0 | 0 | 10 |
| C12 N - butyl glucamide | 0 | 0 | 0 | 0 | 0 | 0 | 0 | 0 |
| C12 N - methoxypropyl glucamide | 0 | 10 | 10 | 0 | 0 | 0 | 0 | 0 |
| C12 N - methyl glycerolamide | 0 | 0 | 0 | 7.2 | 7.2 | 0 | 0 | 0 |
| C12 N - methyl xylose amide | 0 | 0 | 0 | 0 | 0 | 7.2 | 7.2 | 0 |
| Na C 12–14 Alkyl Sulphate | 0 | 0 | 0 | 0 | 0 | 0 | 0 | 0 |
| Boric acid | 1.2 | 0 | 1.2 | 0 | 1 | 0 | 1 | 1.2 |
| Poly Vinyl Pyrrolidone N - oxide | 0 | 0 | 0 | 0 | 0 | 0 | 0 | 0.05 |
| Total parts | 76.2 | 75.0 | 76.2 | 100.0 | 101.0 | 100.0 | 101.0 | 76.3 |
| Polyol surfactant/ boric acid molar ratio | 1.37 | oo | 1.19 | oo | 1.56 | oo | 1.29 | 1.37 |

EXAMPLES XII, XIV AND XVI, outside the scope of the invention, show poor physical stability. The other examples where the molar ratio of the polyol surfactant/boric acid is equal or lower than 2 show good physical stability.

I claim:

1. A non-aqueous liquid detergent composition comprising a surfactant comprising 2 vicinal hydroxyl groups, which surfactant is selected from poly hydroxy fatty acid amides according to the formula:

$$R^2-\underset{\underset{O}{\|}}{C}-\underset{\underset{R^1}{|}}{N}-Z,$$

wherein $R^1$ is H, $C_{1-1}$ hydrocarbyl, 2-hydroxyethyl, 2-hydroxypropyl or a mixture thereof, $R^2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof, characterized in that said composition further comprises a boron comprising compound selected from the group consisting of boric acid and the alkanolamine salts of tetraborate and metaborate wherein the molar ratio of said surfactant to said boron comprising compound is equal to or lower than 2:1.

2. A non-aqueous liquid detergent composition according to claim 1, comprising from 2% to 80% of said surfactant.

3. A non-aqueous liquid detergent composition according to claim 1, comprising from 0.1% to 10% of said boron comprising compound.

4. A non aqueous liquid detergent composition according to claim 1, wherein said boron comprising compound is boric acid.

5. A non-aqueous liquid detergent composition according to claim 1 further comprising a dye transfer inhibition system selected from a) non-iron metallo porphin catalysts and water-soluble or water-dispersible derivatives thereof;

b) non-iron metallo porphyrin catalysts and water-soluble or water-dispersible derivatives thereof;

c) non-iron metallo phthalocyanine catalysts and water-soluble or water-dispersible derivatives thereof;

d) polyamine N-oxides of average molecular weight between 500 and 1,000,000; and e) combinations of said catalysts and said polyamine N-oxides.

* * * * *